US006305491B2

(12) United States Patent
Iwasa et al.

(10) Patent No.: US 6,305,491 B2
(45) **Date of Patent: *Oct. 23, 2001**

(54) SPEAKER

(75) Inventors: Mikio Iwasa, Katano; Hiroyuki Takewa, Kaizuka; Kazue Sato, Neyagawa; Mitsuhiro Hasegawa, Suita, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/306,872

(22) Filed: May 7, 1999

(30) Foreign Application Priority Data

May 8, 1998 (JP) ..... 10-125693
Nov. 18, 1998 (JP) ..... 10-327817

(51) Int. Cl.[7] ..... H04R 7/00
(52) U.S. Cl. ..... 181/172; 181/171; 181/166
(58) Field of Search ..... 181/172, 171, 181/173, 174, 166, 167, 169

(56) References Cited

U.S. PATENT DOCUMENTS 3,858,680 * 1/1975 Tsuge et al. ..... 181/172
3,905,448 * 9/1975 Kawakami et al. ..... 181/172
3,961,378 * 6/1976 White ..... 29/594
3,997,023 * 12/1976 White ..... 181/171
4,584,439 * 4/1986 Paddock ..... 179/115.5 PV
5,162,619 * 11/1992 Thiele et al. ..... 181/166
5,418,337 * 5/1995 Schreiber ..... 181/171
5,455,396 * 10/1995 Willard et al. ..... 181/172
5,661,271 8/1997 Moser .

FOREIGN PATENT DOCUMENTS 55-46649 4/1980 (JP) .
57-54498 3/1982 (JP) .
60-177798 9/1985 (JP) .
1-272300 10/1989 (JP) .
5-236593 9/1993 (JP) .
7-7790 1/1995 (JP) .
7-284193 10/1995 (JP) .

OTHER PUBLICATIONS

European Search Report for EP 99 10 8566 dated Apr. 17, 2001.

* cited by examiner

*Primary Examiner*—Robert E. Nappi
*Assistant Examiner*—Edgardo San Martin
(74) *Attorney, Agent, or Firm*—Ratner & Prestia

(57) ABSTRACT

A speaker includes a diaphragm, a frame accommodating the diaphragm and an edge attached to an outer periphery of the diaphragm as well as to an inner periphery of the frame so as to retain the diaphragm within an interior of the frame. The edge has a thickness which is smallest at substantially a central portion between the diaphragm and the frame and the vicinity thereof, and increases toward the diaphragm and the frame.

16 Claims, 11 Drawing Sheets

SPEAKER

BACKGROUND OF THE INVENTION

1. Field of the Invention

The present invention relates to a speaker with an edge having advantageous characteristics, which is suitable for reproducing an audio signal of a large input.

2. Description of the Related Art

In recent years, a small size sound reproduction device which does not require a large space has been provided for a stereo system or a personal computer to be used at home. A speaker used for such sound reproduction device typically has a diaphragm of a small diameter (hereinafter, referred to as diaphragm diameter).

FIG. 9A is a cross-sectional view of an exemplary structure of a conventional speaker having a small diaphragm diameter. FIG. 9B is an enlarged cross-sectional view illustrating an edge 9 and the vicinity thereof in FIG. 9A. In FIG. 9A, an annular magnetic circuit including a center pole 2, a magnet 3 and a top plate 4 is formed at a lower end of an annular frame 1.

A magnetic flux of a high density is generated in an annular gap 5 formed between an outer periphery of an upper portion of the center pole 2 and an inner periphery of the top plate 4. A voice coil bobbin 6 is retained in the gap 5 in such a way that the voice coil bobbin 6 can vibrate freely in upward and downward directions. A voice coil 10 is wound around the periphery of the voice coil bobbin 6 at a lower portion thereof. When a driving current corresponding to an audio signal is applied to the voice coil 10, an electromagnetic force is generated in the voice coil 10, resulting in a piston-like vibration of the voice coil bobbin 6 in the electric field generated in the gap 5.

A diaphragm 8 is fixed at an upper end of the voice coil bobbin 6, and a damper (also referred to as a suspension) 7 is connected in vicinity of the upper end of the voice coil bobbin 6. The diaphragm 8 is attached to the frame 1 via the edge 9, while the damper 7 is attached to the frame 1 directly. The diaphragm 8 is retained directly by the edge 9 and indirectly by the damper 7, in such a manner that the diaphragm 8 is permitted to vibrate freely.

In the speaker thus structured, when a driving current proportional to the audio signal is applied to the voice coil 10, an electromagnetic force of the voice coil 10 and a magnetic flux of the gap 5 interact with each other, thereby generating a driving force in the voice coil 10, which in turn vibrates the voice coil 10. As the voice coil 10 vibrates, the diaphragm 8 retained by the damper 7 and the edge 9 is vibrated in upward and downward directions, so as to output a sound from the speaker.

As the edge 9 of the speaker, the edge shown in FIGS. 9A and 9B is most commonly used. The edge 9 is referred to as a roll edge since its cross-sectional configuration shows a shape of a semi-circular roll, and the edge 9 is disposed at the outer periphery of and concentrically with the diaphragm 8. As the material of the edge 9, a cloth impregnated with resin, a urethane foam sheet, a rubber sheet orthelike can be used. The roll-shapededge 9 and the wave-shaped (also referred to as a corrugation) damper 7 constitute a supporting system of the diaphragm 8 of the speaker, assuring a large vibration amplitude of the diaphragm 8.

However, a diameter of the diaphragm 8 in the conventional small speaker as shown in FIG. 9A is too small to generate a large sound pressure. In other words, in order to acquire a particular magnitude of sound pressure, the vibration amplitude of the diaphragm 8 needs to be increased in an inverse proportional manner with respect to an area of the diaphragm and the square of a frequency of audio signal.

The highest amplitude of the diaphragm is proportional to a size of the roll of the edge 9. There is no significant difference between the size of the roll in a speaker with a small diaphragm diameter and that of the roll in a speaker with a large diaphragm diameter. Therefore, obtaining a sufficiently large amplitude in a speaker with a small diaphragm diameter is difficult, and thus a problem remains that a reproduced sound deteriorates especially in a low frequency range.

FIG. 10 is a schematic cross-sectional view illustrating a displacement of the roll structure of the edge 9. In FIG. 10, a dashed line shows a state of the edge 9 where a driving current is not applied to the voice coil 10 and the diaphragm 8 is at a neutral position. In contrast, a solid line shows a state of the edge 9 where a large driving current of a low frequency is applied to the voice coil 10 and the diaphragm 8 is displaced along the Z axis in a (+) direction. As is clear from FIG. 10, when a large driving current of a low frequency is applied to the voice coil 10, the edge 9 is extended to be stretched completely.

FIG. 11 illustrates a displacement of the edge 9, measured by a laser Doppler displacement analyzer, in one cycle during which a driving current corresponding to a sound of a drum being attacked is applied to the voice coil 10 and the diaphragm 8 is vibrated at an amplitude within a range of ±10 mm along Z axis. As is clear from FIG. 11, while the edge 9 shows a roll shape when the diaphragm 8 is at a neutral position, the edge 9 is displaced into a straight shape and stretched when the diaphragm 8 vibrates at the amplitude of ±10 mm.

When a large driving current of a low frequency is applied to the voice coil 10, the edge 9 is stretched, and an unusual sound is produced from the edge 9 so as to remarkably deteriorate the quality of a reproduced sound. The unusual sound is the same as a sound generated when a thin sheet of rubber, a cloth, a sheet of paper or the like Is suddenly stretched from a loose state (stretching sound).

SUMMARY OF THE INVENTION

A speaker of this invention includes a diaphragm, a frame accommodating the diaphragm and an edge attached to an outer periphery of the diaphragm as well as to an inner periphery of the frame so as to retain the diaphragm within an interior of the frame, wherein the edge has a thickness, which is smallest at substantially a central portion between the diaphragm and the frame and the vicinity thereof, and increases toward the diaphragm and the frame.

According to the present invention, the edge is formed thin at substantially a central portion thereof and thicker toward the diaphragm and the frame, i.e., an inner and outer peripheries thereof. Thus, a stiffness of the edge is low in the vicinity of the center and is high in the vicinities of the inner and outer peripheries. As a result of the low stiffness, the edge is easily deformed in the vicinity of the center, and a linearity of the displacement of the diaphragm in response to a driving current applied to a voice coil is retained, as long as a vibration amplitude of the diaphragm is kept within a particular range. In addition, when a large stretching force is applied to the edge at a high amplitude of the diaphragm, the stretching force is dispersed by the inner and outer peripheral portions of a high stiffness, thereby preventing the edge from being suddenly stretched completely and preventing a stretching sound due to such sudden stretching from being generated.

In one embodiment of the invention, the edge has a roll shaped cross-section. In other words, the present invention can be applied to the most commonly used edge in which a cross-section thereof is of a roll shape.

In one embodiment of the invention, the edge is formed of a foam material so as to have a structure in which the surface layers are dense, while the interior is coarse. In such a case, the edge is formed to have a sandwich structure in which the surface layers are dense and stiff, while the interior is coarse and light-weight, thereby enabling an acquisition of a light-weight, but thick, edge having an appropriate stiffness and viscoelasticity as a supporting system of a diaphragm. In addition, as compared to an edge made of a foam material having a uniform quality from a surface to an interior, the above-described edge is less affected by an ultraviolet ray or humidity and a stiffness thereof is not easily changed even under a high temperature and humidity. As result, a low sound characteristic of a speaker is maintained to be stabilized.

Moreover, a speaker of the present invention includes a diaphragm, a frame accommodating the diaphragm, and an edge attached to an outer periphery of the diaphragm as well as to an inner periphery of the frame so as to retain the diaphragm within an interior of the frame, wherein a cross-section of the edge includes at least three roll-shaped portions including an innermost roll-shaped portion, an outermost roll-shaped portion and at least one central roll-shaped portion, and the innermost roll-shaped portion and the outermost roll-shaped portion each have a thickness greater than a thickness of the at least one central roll-shaped portion.

Further, a speaker of the present invention includes a diaphragm, a frame accommodating the diaphragm, and an edge attached to an outer periphery of the diaphragm as well as to an inner periphery of the frame so as to retain the diaphragm within an interior of the frame, wherein a cross-section of the edge includes at least three roll-shaped portions including an innermost roll-shaped portion, an outermost roll-shaped portion and at least one central roll-shaped portion, and the innermost roll-shaped portion. and the outermost roll-shaped portion each have a radius, different from a radius of the at least one central roll-shaped portion.

In such structure, a stiffness is low in the vicinity of the center of the edge and high in the vicinities of the inner and outer peripheries of the edge. Accordingly, the edge is easily deformed in the vicinity of the center and a linearity of the displacement of the diaphragm in response to a driving current applied to a voice coil is retained as long as a vibration amplitude of the diaphragm is kept within a particular range. In addition, when a large stretching force is applied to the edge at a high amplitude of the diaphragm, the stretching force is dispersed by the inner and outer peripheral portions of a high stiffness of the edge, thereby preventing the edge from being suddenly stretched completely and preventing a stretching sound due to such sudden stretching from being generated.

In one embodiment of the invention, the speaker is formed in such a way that the innermost roll-shaped portion and the outermost roll-shaped portion each have a radius smaller than a radius of the at least one central roll-shaped portion.

In addition, a speaker of the present invention includes a diaphragm, a frame accommodating the diaphragm, and an edge attached to an outer periphery of the diaphragm as well as to an inner periphery of the frame so as to retain the diaphragm within an interior of the frame, wherein a cross-section of the edge includes at least three roll-shaped portions including an innermost roll-shaped portion, an outermost roll-shaped portion and at least one central roll-shaped portion, and the innermost roll-shaped portion and the outermost roll-shaped portion each have a thickness and a radius different from a thickness and a radius of the at least one central roll-shaped portion.

In such structure, a stiffness is low in the vicinity of the center of the edge and high in the vicinities of the inner and outer peripheries of the edge. Accordingly, a linearity of the displacement of the diaphragm in response to a driving current applied to a voice coil can be retained as long as a vibration amplitude of the diaphragm is kept within a particular range, and when a large stretching force is applied to the edge at a high amplitude of the diaphragm, the edge can be prevented from being suddenly stretched completely, thereby preventing a stretching sound.

In one embodiment of the invention, the speaker of the present invention is formed in such a way that the innermost roll-shaped portion and the outermost roll-shaped portion each have a thickness greater than a thickness of the at least one central roll-shaped portion, and a radius smaller than a radius of the at least one central roll-shaped portion.

Alternatively, a speaker of the present invention includes a diaphragm, a frame accommodating the diaphragm, and an edge attached to an outer periphery of the diaphragm as well as to an inner periphery of the frame so as to retain the diaphragm within an interior of the frame, wherein the. Rigidity of the edge is smallest at substantially a central portion between the diaphragm and the frame, and increases toward the diaphragm and the frame.

In such a structure, a stiffness is low in the vicinity of a center of the edge and high in the vicinities of the inner and outer peripheries of the edge. Accordingly, a linearity of the displacement of the diaphragm in response to a driving current applied to a voice coil can be retained as long as a vibration amplitude of the diaphragm is kept within a particular range, and when a large stretching force is applied to the edge at a high amplitude of the diaphragm, the edge can be prevented from being suddenly stretched completely, thereby preventing a stretching sound.

Thus, the invention described herein makes possible the advantages of providing a speaker in which a linearity of displacement of a diaphragm, in response to a driving current applied to a voice coil, is not deteriorated significantly, and thus generation of a stretching sound due to a stretching of an edge at a large amplitude of the diaphragm is prevented.

These and other advantages of the present invention will become apparent to those skilled in the art upon reading and understanding the following detailed description with reference to the accompanying figures.

DESCRIPTION OF THE PREFERRED EMBODIMENTS

Example 1

Figure 1A:
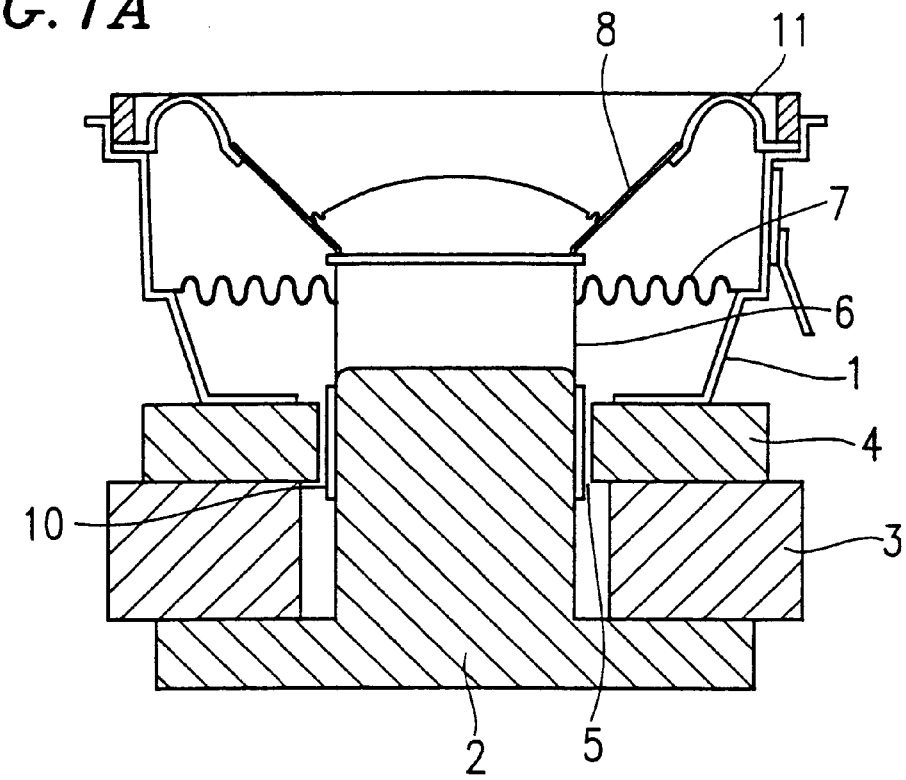
FIG. 1A is a cross-sectional view of a speaker in Example 1 according to the present invention.
Figure 1B:
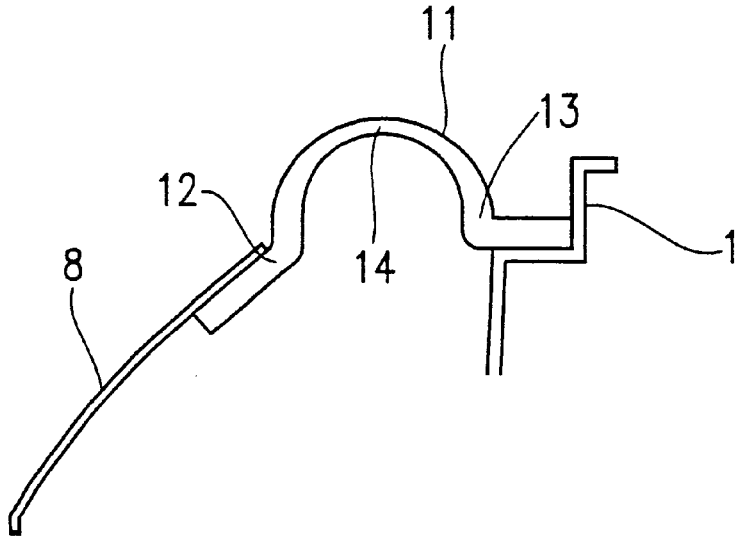
FIG. 1B is an enlarged cross-sectional view of an edge of the speaker and the vicinity thereof in Example 1.

FIG. 1A is a cross-sectional view of a speaker according to Example 1 of the present invention. FIG. 1B is an enlarged cross-sectional view illustrating an edge of the speaker and the vicinity thereof in FIG. 1A.

Figure 9A:
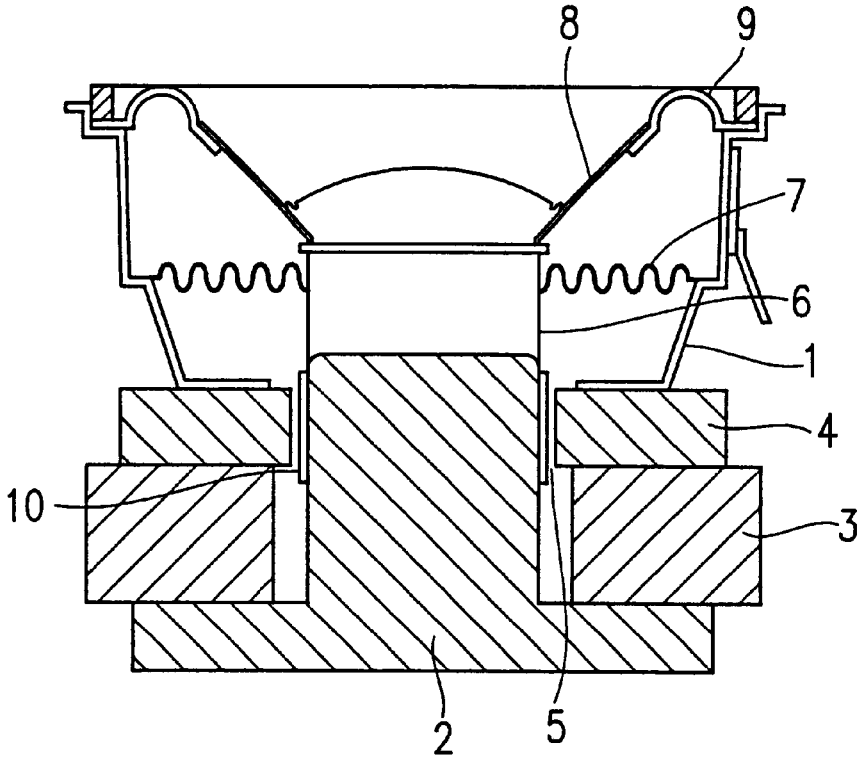
FIG. 9A PRIOR ART
FIG. 9A is a cross-sectional view of an exemplary structure of a conventional speaker having a small diaphragm diameter.
Figure 9B:
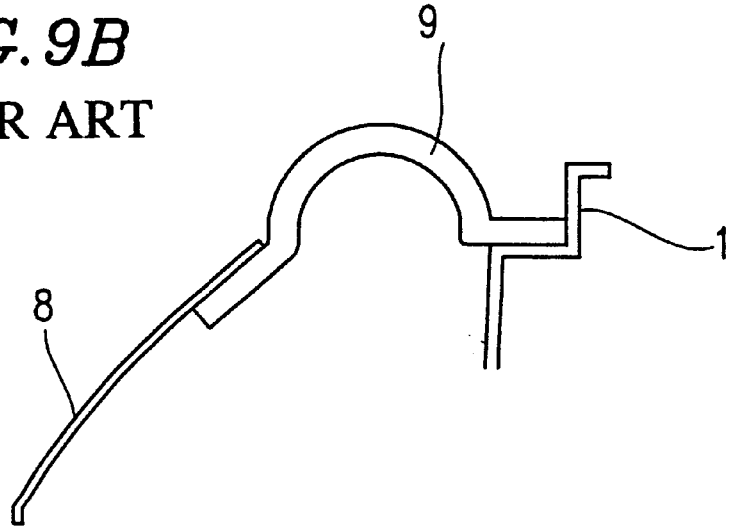
FIG. 9B PRIOR ART
FIG. 9B is an enlarged cross-sectional view of an edge of the speaker and the vicinity thereof in FIG. 9A.
Figure 10:
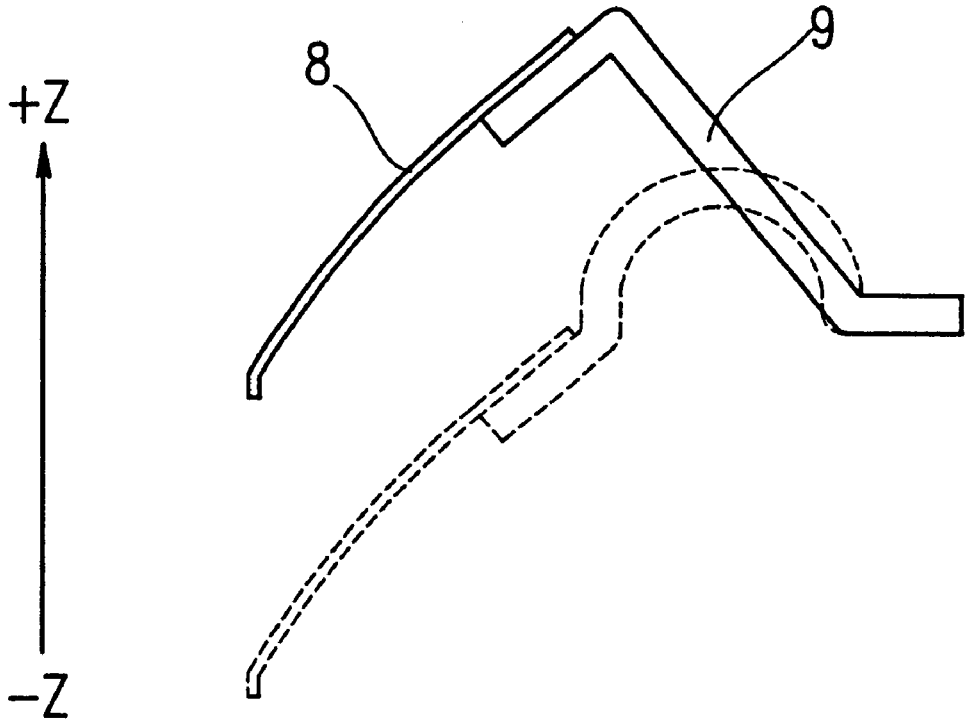
FIG. 10 PRIOR ART
FIG. 10 is a schematic cross-sectional view illustrating a displacement of the edge of the conventional speaker in FIGS. 9A and 9B.
Figure 11:
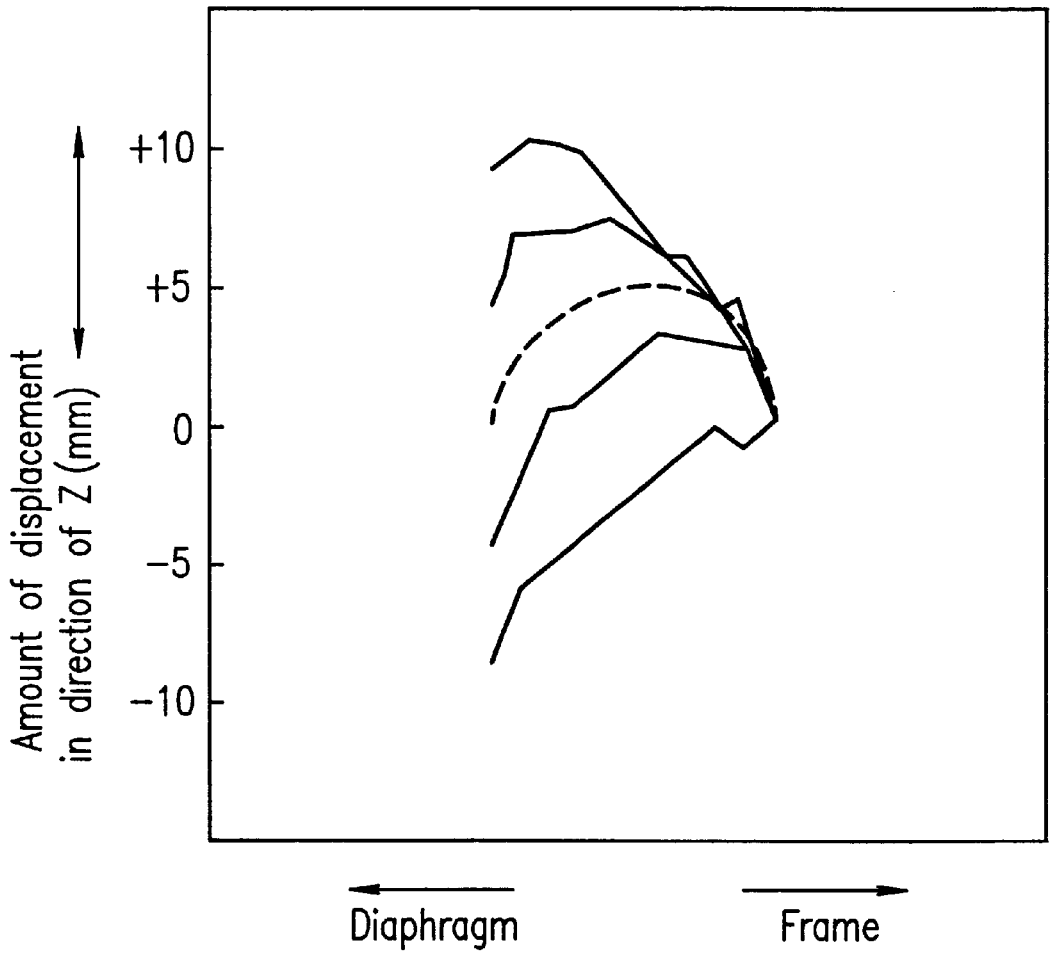
FIG. 11 PRIOR ART
FIG. 11 is a graph showing one cycle of displacement the edge of the conventional speaker in FIGS. 9A and 9B.

Elements previously discussed with respect to FIGS. 9A and 9B that also appear in this and the following examples bear identical numerals for simplicity.

In FIGS. 1A and 1B, an annular magnetic circuit including a center pole 2, a magnet 3, and a top plate 4 is formed at a lower end of an annular frame 1.

In an annular gap 5 formed between an outer periphery of an upper portion of the center pole 2 and an inner periphery of the top plate 4, a voice coil bobbin 6 is retained so as to freely vibrate in upward and downward directions. A voice coil 10 is wound around an outer periphery of the voice coil bobbin 6 at a lower portion thereof. A diaphragm 8 is fixed at an upper end of the voice coil bobbin 6, and a damper (also referred to as a suspension) 7 is connected to a vicinity of the upper end of the voice coil bobbin 6.

While an edge 11 is connected to an outer periphery of the diaphragm 8, the edge 11 is also connected to an inner periphery of the frame 1 so as to retain the diaphragm 8 within an interior of the frame 1. The damper 7 is attached directly to the frame 1. The edge 11 and the damper 7 retain the diaphragm 8 in such a way that the diaphragm 8 can vibrate freely.

The edge 11 is formed of a rubber material, and shows a convex roll shape in a cross-sectional view. A thickness of the edge 11 is the lowest at its top portion 14 and gradually Increased toward an. Inner peripheral portion 12 and an outer peripheral portion 13 away from the top portion 14. The outer peripheral portion 13 is fixed to the frame 1, and the Inner peripheral portion 12 is bonded to the diaphragm 8.

Although the edge 11 is depicted to have a semi-circular roll shape here, other shapes such as circular arc, oval, ellipse formed by combining arcs and straight lines, or a combination of a convex circular arc and a concave circular arc can also be employed. Further, a wave shape formed by combining a plurality of semi-circles or other shapes such as arcs, trapezoids, flat shapes or the like can also be employed.

In such a structure, when a driving current proportional to an audio signal is applied to the voice coil 10, an electromagnetic force of the voice coil 10 and a magnetic flux of the gap 5 interact with each other, thereby generating a driving force in the voice coil 10, which in turn vibrates the voice coil 10. As the voice coil 10 vibrates, the diaphragm 8 is vibrated in upward and downward directions so as to output a sound from the speaker.

Figure 2:
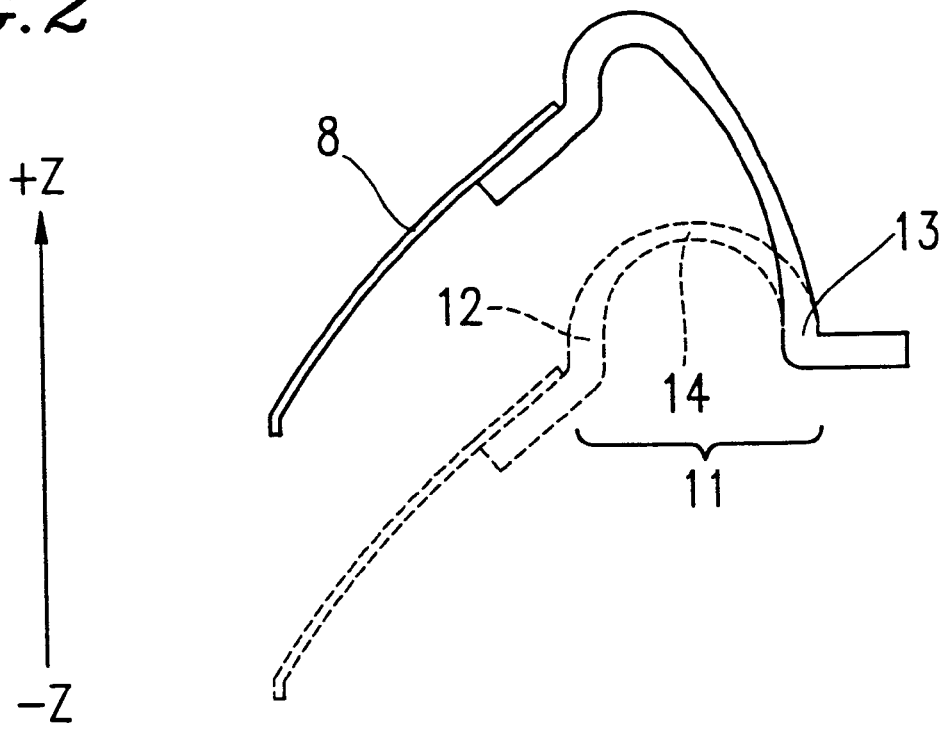
FIG. 2 is a schematic cross-sectional view illustrating a displacement of the edge of the speaker in Example 1.

FIG. 2 is a schematic cross-sectional view illustrating a displacement of the edge 11. In FIG. 2, the Z axis represents a direction of vibration of the voice coil bobbin 6, (+) is a direction towards the front area of the speaker (a direction of a sound output) and (−) is a direction towards the back area of the speaker. A dashed line shows a state of the edge 11 where a driving current is not applied to the voice coil 10 and the diaphragm 8 is at a neutral position. In contrast, a solid line shows a state of the edge 11 where a large driving current of a low frequency is applied to the voice coil 10 and the diaphragm 8 is displaced along the Z axis in the (+) direction.

The inner peripheral portion 12 of the edge 11 is bonded to the diaphragm 8, and thus vibrates together with the diaphragm 8. The other peripheral portion, i.e., the outer peripheral portion 13 is fixed to the frame 1, and thus is not displaced. The top portion 14 of the edge 11 is thin and has a low stiffness. Thus, the top portion 14 is stretched linearly.

The inner peripheral portion 12 and the outer peripheral portion 13 of the edge 11 are thick and stiff, and thus are stretched by the load (corresponding to a magnitude of displacement) of the diaphragm 8 in a lesser amount in comparison with the conventional edge having a uniform thickness as in FIGS. 9A and 9B. Asia result, the inner peripheral portion 12 and the outer peripheral portion 13 are not stretched completely as is the case for the conventional edge 9 in FIGS. 9A and 9B. When an excessive driving current is applied to the voice coil 10 and thus an excessive weight is placed on the diaphragm 8, the inner and outer peripheral portions 12 and 13 of the edge 11 are stretched loosely and a mild braking force is applied to the diaphragm 8.

Figure 3:
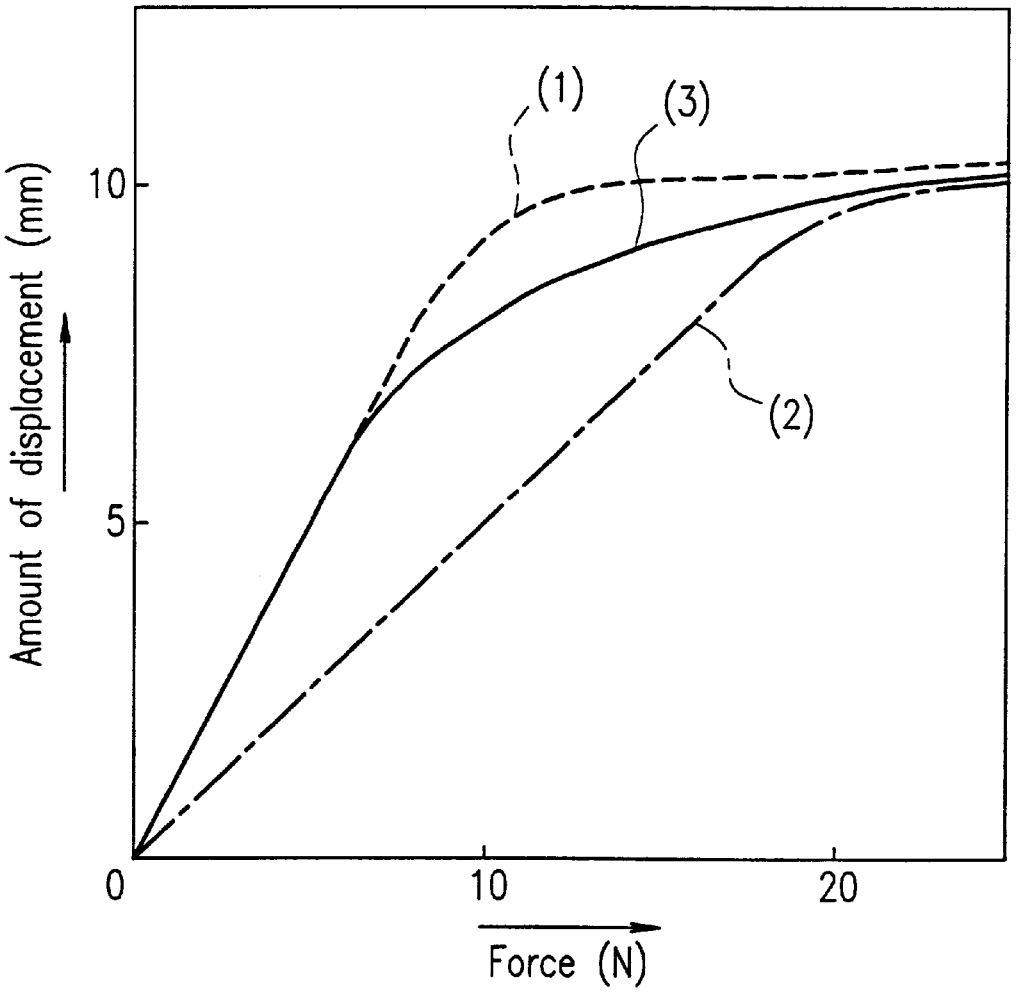
FIG. 3 is a graph showing an amount of displacement in an inner peripheral portion of the edge of the speaker in Example 1, in response to a force (N) applied to the inner peripheral portion.

FIG. 3 is a graph showing an amount of displacement of the inner peripheral portion 12 of the edge 11 in response to a force (N) applied to the inner peripheral portion 12. In FIG. 3, a dashed line (1) shows a characteristic curve taken from a conventional edge made of rubber with a uniform thickness of 0.5 mm and having a roll-shaped cross-section; a chain line (2) shows a characteristic curve taken from a conventional edge made of rubber with an uniform thickness of 1.0 mm and having a roll-shaped cross-section; and a solid line (3) shows a characteristic curve taken from the rubber edge 11 of this example in which the top portion 14 has a thickness of 0.5 mm, which increases gradually toward 1.0 mm at the inner peripheral portion 12 and the outer peripheral portion 13.

In the case of the conventional edge having a uniform thickness of 0.5 mm, as is clear from the characteristic curve of the dashed line (1), gradient of displacement to applied force is suddenly altered at the force (load) of 10(N). The amount of displacement remains approximately constant when the force applied is greater than or equal to 10(N), resulting in a state where the edge is stretched. Moreover, in the case of the conventional edge having a uniform thickness of 1.0 mm, as is clear from the characteristic curve of the chain line (2), the amount of displacement becomes approximately constant when the force is greater than or equal to 20(N). A slope of these characteristic curves shows a stiffness of the edge. The characteristic curve of the dashed line (1) has a steep slope, and thus the stiffness of the edge is low. Such a low value of the stiffness is suitable for a supporting system of the diaphragm. On the contrary, the characteristic curve of the chain line (2) has a low slope, and thus the stiffness of the edge is excessively high for a supporting system of the diaphragm. It is difficult for such a stiff edge to reproduce an audio signal of a low frequency.

In the case of the rubber edge 11 of this example (top portion 14: 0.5 mm thick, inner peripheral portion 12 and outer peripheral portion 13: 1.0 mm thick), as is clear from the characteristic curve of the solid line (3), the thin top portion 14 is deformed when the force (N) applied to the inner peripheral portion 12 of the edge 11 is low, and thus the amount of displacement alters linearly with respect to the force (N). As the force (N) increases, the inner peripheral portion 12 and the outer peripheral portion 13 and the vicinities thereof, which are formed thick, are gradually deformed, resulting in a slow alteration in the amount of displacement in response to the force (N) applied. When the force (N) is small, the characteristic curve of the solid line (3) and that of the dashed line (1) nearly coincide. When the force (N) is between 8(N) and 15(N), the characteristic curve of the solid line (3) is at an intermediary position between the characteristic curves of the dashed line (1) and the chain line (2). In this case, as the force (N) increases, the amount of displacement is altered more gradually in response to the force (N).

Thus, as the force (N) increases, the displacement of the edge 11 at the inner peripheral portion 12 becomes gradual, so that the edge 11 is not suddenly stretched. In view of the stiffness, when the force (N) is relatively small, the thin top portion 14 is mainly deformed, resulting in a low and suitable value of stiffness. When the force (N) becomes large, the inner peripheral portion 12, the outer peripheral portion 13 and the vicinities thereof, which are made thick, are mainly deformed, resulting in a high stiffness. In such a case, the edge 9 as a supporting system of the diaphragm 8 is excessively stiff in response to the excessive force to allow the diaphragm 8 to vibrate.

Figure 4:
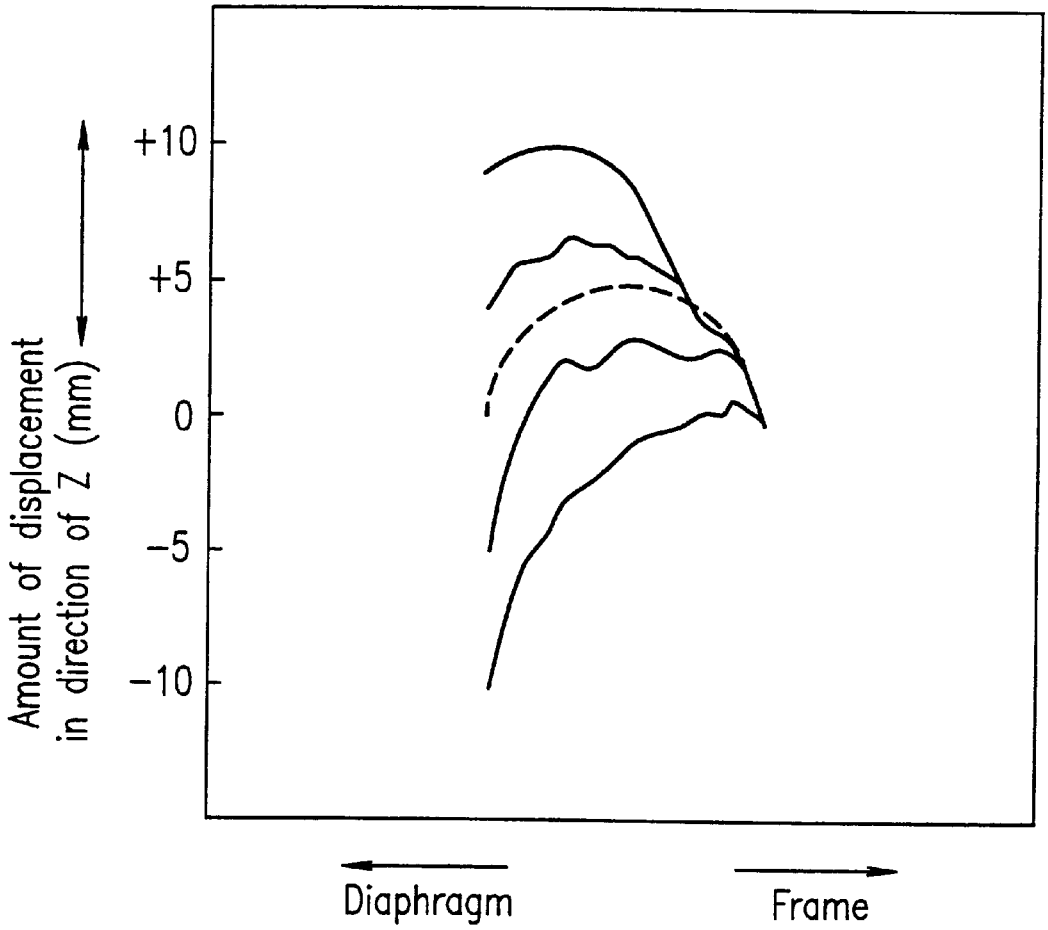
FIG. 4 is a graph showing one cycle of displacement of the edge of the speaker in Example 1.

FIG. 4 illustrates a displacement of the edge 11, measured by a laser Doppler displacement analyzer, in one cycle during which a driving current corresponding to a sound of a drum being attacked is applied to the voice coil 10 of a speaker according to this example and the diaphragm 8 is vibrated at an amplitude within a range of ±10 mm along Z axis. As can be seen in FIG. 4, even when the diaphragm 8 vibrates at an amplitude of ±10 mm, the edge 11 is not stretched completely and maintains a portion of original form, so that a stretching sound resulting from stretching the edge is prevented.

As described above, the edge 11 of a speaker according to this example has an uneven thickness such that a top portion is made thin while inner and outer peripheral portions are made thick. Such an edge has advantages of both a uniformly thin edge which is flexible and easily deformed and a uniformly thick edge which is stiff and not easily stretched.

Example 2

Figure 5:
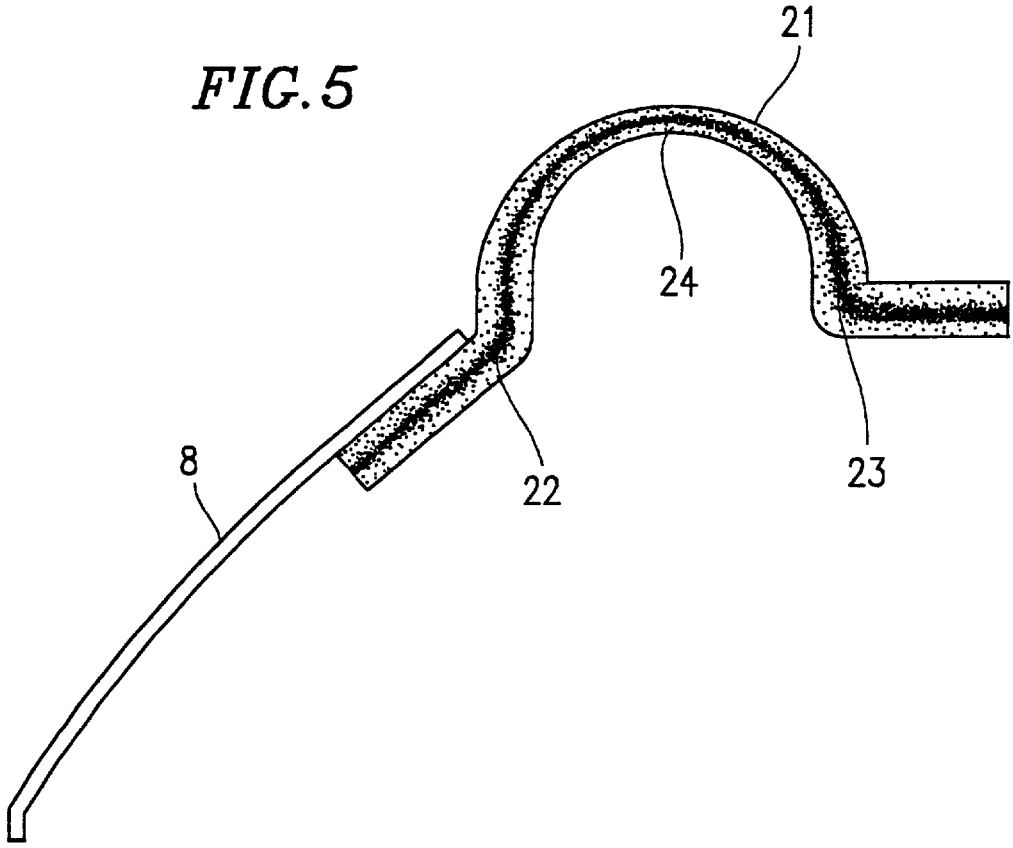
FIG. 5 is an enlarged cross-sectional view of an edge of a speaker in Example 2 according to the present invention.

FIG. 5 is an enlarged cross-sectional view of an edge of a speaker in Example 2 according to the present invention. Although a material of an edge 21 of the present example is different from that of the edge 11 of Example 1, the edge 21 has exactly the same shape as the edge 11 of Example 1 and is applied to a speaker in FIG. 1.

A porous rubber foam is used as a material of the edge 21 of the present example, and the edge 21 is formed by molding.

A hollow portion of a mold used for forming the edge 21 has the same shape as an exterior shape of the edge 21. Specifically, a cross-section of the hollow portion is of a roll shape, where a portion corresponding to a top portion 24 of the edge 21 is the thinnest and portions corresponding to an inner peripheral portion 22 and an outer peripheral portion 23 are the thickest. The edge 21 is formed by foaming a rubber material in the hollow portion. A foam magnification (coefficient of volume expansion of a material caused by foaming) of the rubber material is set so as to be low in surface layers and to increase toward the interior of the edge.

Consequently, the edge 21 has a sandwich structure in which the surface layers are dense and stiff, while the interior is coarse and light-weight. As compared to a sheet of rubber of the same weight, the edge 21 can be made to have a greater thickness and a higher stiffness. In addition, since the foam magnification is varied, the weight and the stiffness of the edge 21 can easily be adjusted, thereby enabling the stiffness and viscoelasticity to be set suitably. Accordingly, as is seen in Example 1, the edge 21 has both the advantage of being flexible and easily deformed in a certain range of a vibration amplitude of the diaphragm 8, and the advantage of not being stretched easily even at a high vibration amplitude so that a stretching sound is prevented. Moreover, as compared with an edge made of a urethane foam having a uniform foam magnification, a surface layer of the edge 21 is dense and stiff so that the edge 21 has excellent weather resistance and humidity resistance. As a result, the stiffness of the edge 21 does not alter easily under a high temperature and humidity and a low sound reproduction characteristic of the edge 21 can be maintained to be stabilized.

Example 3

Figure 6A:
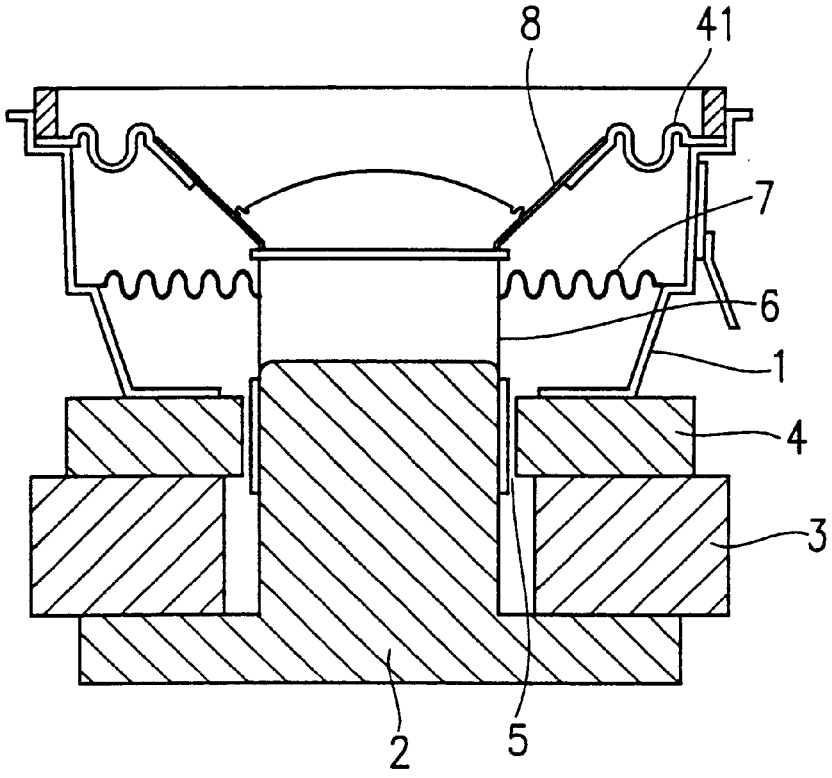
FIG. 6A is a cross-sectional view of a speaker in Example 3 according to the present invention.
Figure 6B:
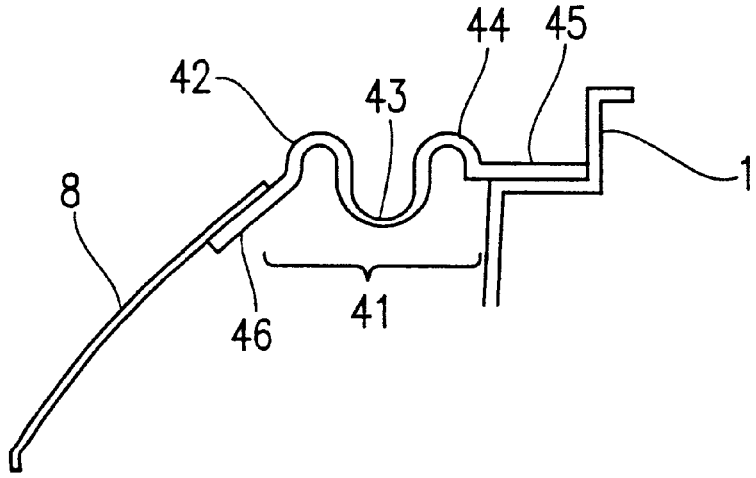
FIG. 6B is an enlarged cross-sectional view of the edge of the speaker and the vicinity thereof in Example 3.

FIG. 6A is a cross-sectional view of a speaker in Example 3 according to the present invention. FIG. 6B is an enlarged cross-sectional view illustrating an edge of the speaker and the vicinity thereof in FIG. 6A.

In the present example, an edge 41 has three consecutive roll portions 42, 43, and 44 (FIG. 6B). The roll portion 42 is In the vicinity of an Inner periphery, the roll portion 44 is in the vicinity of an outer periphery, and the roll portion 43 is in a central portion therebetween. The edge 41 is thinnest in a center portion (central portion) and becomes thicker gradually toward the inner peripheral portion 46 and the outer peripheral portion 45. The outer peripheral portion 45 is bonded to the frame 1, and the inner periphery 46 is bonded to the diaphragm 8.

As in the case of Examples 1 and 2, the edge 41 of the present example has both the advantage of being flexible and easily deformed in a certain range of a vibration amplitude of the diaphragm 8, and the advantage of not being stretched easily even at a high vibration amplitude so that a stretching sound is prevented.

Although the thickness of the edge 41 is varied gradually in the present example, only the roll portion 43 may be formed thin while the roll portions 42 and 44 may be formed thick. Alternatively, there may be four consecutive roll portions.

Example 4

Figure 7A:
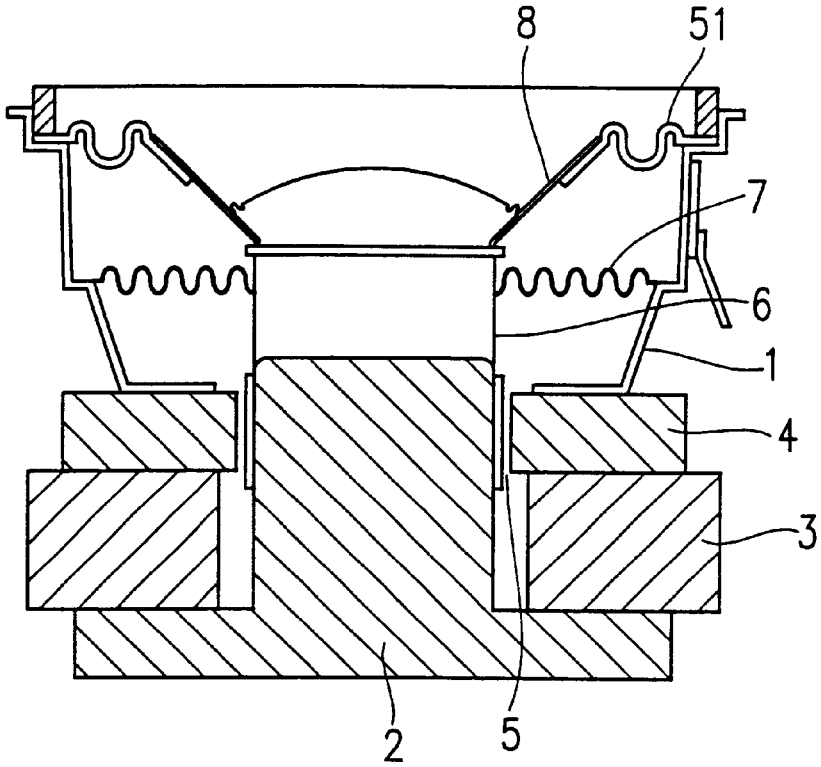
FIG. 7A is a cross-sectional view of a speaker in Example 4 according to the present invention.
Figure 7B:
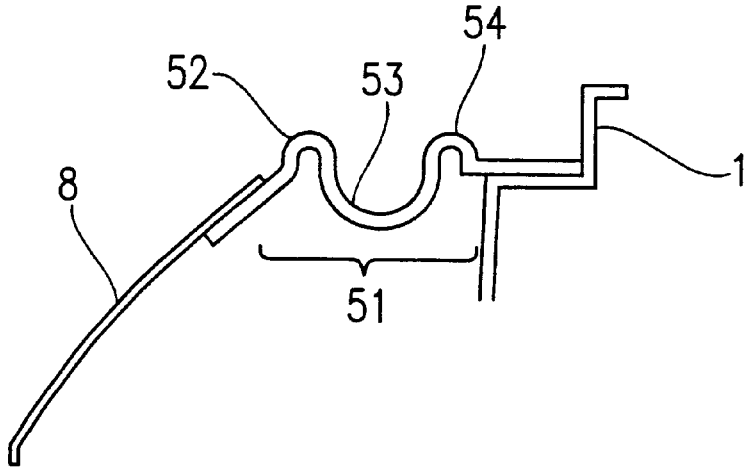
FIG. 7B is an enlarged cross-sectional view of the edge and the vicinity thereof in Example 4.

FIG. 7A is a cross-sectional view of a speaker in Example 4 according to the present invention. FIG. 7B is an enlarged cross-sectional view illustrating an edge of the speaker and the vicinity thereof In FIG. 7A.

An edge 51 of the present example has three consecutive roll portions 52, 53, and 54. The roll portion 52 Is in the vicinity of an inner periphery, the roll portion 54 is in the vicinity of an outer periphery, and the roll portion 53 is in a central portion therebetween. A radius of the roll portions 52 and 54 is smaller than that of the roll portion 53. As a radius of a roll portion decreases, a stiffness of the edge for retaining a diaphragm 8 rises, thereby reducing an amount of displacement of the roll portion in response to a force (N) applied to an inner peripheral portion of the edge 51. Reducing the radius has the same effect as increasing a thickness of the edge. Thus, the edge 51 of the present example has the roll portion 53 in the center, which is flexible and easily deformed, as well as the roll portions 52 and 54 in the vicinity of the inner and outer peripheries, which are stiff and not easily stretched. Accordingly, as in the case of Examples 1 to 3, both the advantage of being flexible and easily deformed in a certain range of a vibration amplitude of the diaphragm 8, and the advantage of not being stretched easily even at a high vibration amplitude so that a stretching sound is prevented, can be realized.

By varying a thickness of the edge 51, a linearity of force displacement characteristics and a braking effect of the edge 51 can be adjusted.

In addition, as in the case of Example 3, the edge 51 may be formed to be thin in the center, and to become gradually thicker toward the inner and outer peripheral portions. By doing so, the braking effect can be further increased.

Figure 8A:
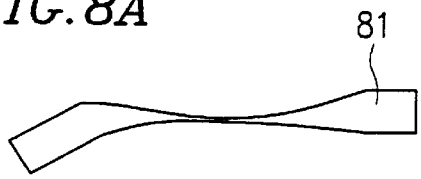
FIGS. 8A through 8I are cross-sectional views of various edges usable in a speaker of the present invention.
Figure 8B:
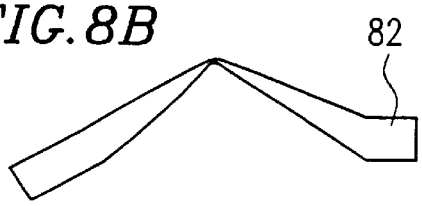
Figure 8C:
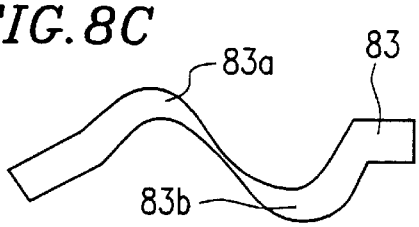
Figure 8D:
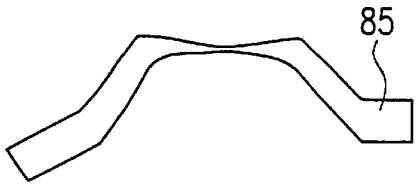
Figure 8E:
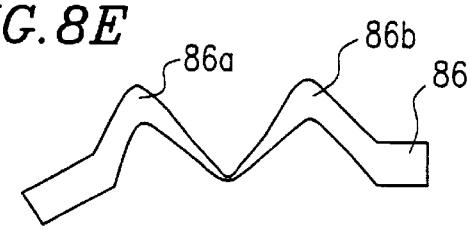
Figure 8F:
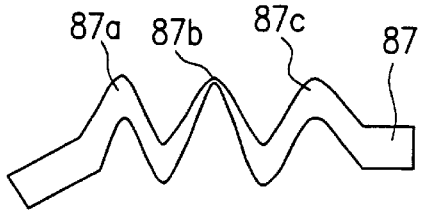
Figure 8G:
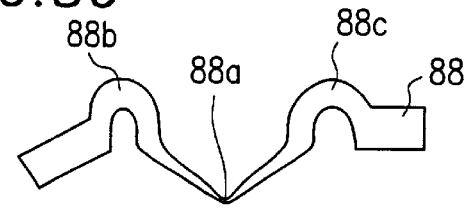
Figure 8H:
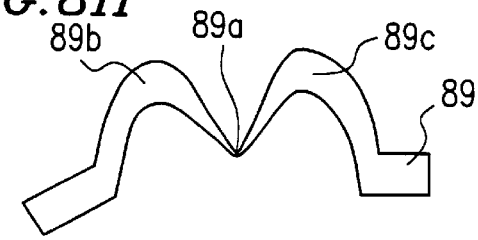
Figure 8I:
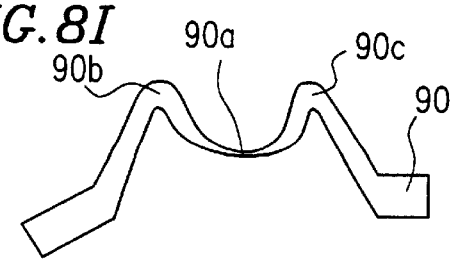

The present invention is not limited to each of the above-described examples and may be modified in various forms. FIGS. 8A through 8I shows a plurality of variations in a cross-sectional shape of an edge. An edge in FIG. 8A is generally flat, and an edge 82 in FIG. 8B is projected in a center. An edge 83 in FIG. 8C has two consecutive roll portions, namely a concave roll portion 83 *a* and a convex roll portion 83 *b*. An edge 85 in FIG. 8D has a trapezoidal projection. An edge 86 in FIG. 8E has two consecutive wave shaped projections 86*a* and 86*b*, and an edge 87 in FIG. 8F has three consecutive wave shaped projections 87*a*, 87*b* and 87*c*. An edge 88 in FIG. 8G has a concave portion 88*a* in a center and roll portions 88*b* and 88*c*, each of which has a smaller radius, in the vicinity of inner and outer peripheries. An edge 89 in FIG. 8H has a concave portion 89*a* in a center as well as roll portions 89*b* and 89*a* respectively in the vicinity of inner and outer peripheries. An edge 90 in FIG. 8I has a concave portion 90*a* in a center as well as wave shaped projections 90*b* and 90*c* respectively at inner and outer peripheries. Any of the edges 81 through 90 is formed to be thinnest in a center portion and to become thicker toward inner and outer peripheral portions. Due to such shapes, the edges 81 through 90 each has both the advantage of being flexible and easily deformed in a certain range of a vibration amplitude of the diaphragm, and the advantage of not being stretched easily even at a high vibration amplitude so that a stretching sound is prevented.

In each of the edges in the above-described examples and variations, the rigidity is smallest in a center and increases toward inner and outer peripheries. Any edge in which the rigidity is distributed in this manner is included in the scope of the present invention.

As is described above, according to the present invention, a stiffness of an edge is low in the vicinity of a center portion, and is high in the vicinities of inner and outer peripheries. Due to a low stiffness of the edge in a vicinity of a center portion, the edge is easily deformed in the vicinity of the center portion and a linearity of displacement of a diaphragm in response to a driving current applied to a voice coil is maintained, as long as a vibration amplitude of the diaphragm is within a particular range. In addition, when a large magnitude of a tensile stress is applied to the edge at a high amplitude of vibration of the diaphragm, the tensile stress is dispersed by the inner and outer peripheral portions of the edge, having a high stiffness, so as to prevent the edge from being jerked and suddenly stretched completely, and to prevent a stretching sound from being generated.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A speaker, comprising:

a diaphragm;

a frame accommodating the diaphragm; and an edge attached to an outer periphery of the diaphragm as well as to an inner periphery of the frame so as to retain the diaphragm within an interior of the frame, wherein the edge has a thickness which is smallest at substantially a central portion between the diaphragm and the frame and the vicinity thereof, and increases toward the diaphragm and the frame, wherein the edge is formed of a foam material so as to have a structure in which the surface layers are dense, while the interior is porous, wherein the edge retains the diaphragm in such a way that the diaphragm can vibrate freely, and one end portion of the edge is attached to the diaphragm so as to vibrate with the diaphragm.

2. A speaker according to claim 1, wherein the edge has a roll shaped cross-section.

3. A speaker, comprising:

a diaphragm;

a frame accommodating the diaphragm; and an edge attached to an outer periphery of the diaphragm as well as to an inner periphery of the frame so as to retain the diaphragm within an interior of the frame, wherein a cross-section of the edge includes at least three roll-shaped portions including an innermost roll-shaped portion, an outermost roll-shaped portion and at least one central roll-shaped portion, the innermost roll-shaped portion and the outermost roll-shaped portion each have a thickness greater than a thickness of the at least one central roll-shaped portion, wherein the edge is formed of a foam material so as to have a structure in which the surface layers are dense, while the interior is porous, wherein the edge retains the diaphragm in such a way that the diaphragm can vibrate freely, and one end portion of the edge is attached to the diaphragm so as to vibrate with the diaphragm.

4. A speaker, comprising:

a diaphragm;

a frame accommodating the diaphragm; and an edge attached to an outer periphery of the diaphragm as well as to an inner periphery of the frame so as to retain the diaphragm within an interior of the frame, wherein a cross-section of the edge includes at least three roll-shaped portions including an innermost roll-shaped portion, an outermost roll-shaped portion and at least one central roll-shaped portion, the innermost roll-shaped portion and the outermost roll-shaped portion each have a radius different from a radius of the at least one central roll-shaped portion, wherein a radius of the at least one central roll-shaped portion gradually decreases toward the innermost roll-shaped portion and the outermost roll-shaped portion, wherein the edge retains the diaphragm in such a way that the diaphragm can vibrate freely, and one end portion of the edge is attached to the diaphragm so as to vibrate with the diaphragm.

5. A speaker according to claim 4, wherein the innermost roll-shaped portion and the outermost roll-shaped portion each have a radius smaller than a radius of the at least one central roll-shaped portion.

6. A speaker, comprising:

a diaphragm;

a frame accommodating the diaphragm; and an edge attached to an outer periphery of the diaphragm as well as to an inner periphery of the frame so as to retain the diaphragm within an interior of the frame, wherein a cross-section of the edge includes at least three roll-shaped portions including an innermost roll-shaped portion, an outermost roll-shaped portion and at least one central roll-shaped portion, the innermost roll-shaped portion and the outermost roll-shaped portion each have a thickness and a radius different from a thickness and a radius of the at least one central roll-shaped portion, wherein a radius of the at least one central roll-shaped portion gradually decreases toward the innermost roll-shaped portion and the outermost roll-shaped portion, wherein the edge retains the diaphragm in such a way that the diaphragm can vibrate freely, and one end portion of the edge is attached to the diaphragm so as to vibrate with the diaphragm.

7. A speaker according to claim 6, wherein the innermost roll-shaped portion and the outermost roll-shaped portion each have a thickness greater than a thickness of the at least one central roll-shaped portion, and a radius smaller than a radius of the at least one central roll-shaped portion.

8. A speaker, comprising:

a diaphragm;

a frame accommodating the diaphragm; and an edge attached to an outer periphery of the diaphragm as well as to an inner periphery of the frame so as to retain the diaphragm within an interior of the frame, wherein the rigidity of the edge is smallest at substantially a central portion between the diaphragm and the frame, and increases toward the diaphragm and the frame, wherein the edge is formed of a foam material so as to have a structure in which the surface layers are dense, while the interior is porous, wherein the edge retains the diaphragm in such a way that the diaphragm can vibrate freely, and one end portion of the edge is attached to the diaphragm so as to vibrate with the diaphragm.

9. A speaker according to claim 1, wherein the thickness of the edge is gradually increased toward the diaphragm and the frame.

10. A speaker according to claim 3, wherein the thickness of the at least one central roll-shaped portion gradually increases toward the innermost roll-shaped portion and the outermost roll-shaped portion.

11. A speaker according to claim 4, wherein the edge is formed of a foam material so as to have a structure in which the surface layers are dense, while the interior is porous.

12. A speaker according to claim 6, wherein a thickness of the at least one central roll-shaped portion gradually increases toward the innermost roll-shaped portion and the outermost roll-shaped portion.

13. A speaker according to claim 6, wherein the edge is formed of a foam material so as to have a structure in which the surface layers are dense, while the interior is porous.

14. A speaker according to claim 8, wherein the rigidity of the edge is gradually increased toward the diaphragm and the frame.

15. A speaker, comprising:

a diaphragm;

a frame accommodating the diaphragm; and an edge attached to an outer periphery of the diaphragm as well as to an inner periphery of the frame so as to retain the diaphragm within an interior of the frame, wherein a cross-section of the edge includes at least three roll-shaped portions including an innermost roll-shaped portion, an outermost roll-shaped portion and at least one central roll-shaped portion; and the innermost roll-shaped portion and the outermost roll-shaped portion each have a radius different from a radius of the at least one central roll-shaped portion, wherein the edge is formed of a foam material so as to have a structure in which the surface layers are dense, while the interior is porous.

16. A speaker, comprising:

a diaphragm;

a frame accommodating the diaphragm; and an edge attached to an outer periphery of the diaphragm as well as to an inner periphery of the frame so as to retain the diaphragm within an interior of the frame, wherein a cross-section of the edge includes at least three roll-shaped portions including an innermost roll-shaped portion, an outermost roll-shaped portion and at least one central roll-shaped portion; and the innermost roll-shaped portion and the outermost roll-shaped portion each have a thickness and a radius different from a thickness and a radius of the at least one central roll-shaped portion, wherein the edge is formed of a foam material so as to have a structure in which the surface layers are dense, while the interior is porous.

* * * * *